US005581989A

United States Patent [19]

Mann et al.

[11] Patent Number: 5,581,989

[45] Date of Patent: Dec. 10, 1996

[54] SPINDLE FOR SPINNING MACHINE WITH KNURLED RESERVE SURFACE

[75] Inventors: Peter Mann, Süssen; Jakob Bothner, Göppingen; Frieder Probst, Eislingen, all of Germany

[73] Assignee: Zinser Textilmaschinen GmbH, Ebersbach/Fils

[21] Appl. No.: 330,711

[22] Filed: Oct. 28, 1994

[30] Foreign Application Priority Data

Oct. 29, 1993 [DE] Germany ..... 43 371 00.0

[51] Int. Cl.[6] ..... D01H 7/04; D01H 9/14; B65H 54/00

[52] U.S. Cl. ..... 57/129; 57/303; 57/306; 242/18 EW; 72/703; 29/DIG. 23

[58] Field of Search ..... 242/19, 18 R, 242/18 EW, 18 PW, 48; 57/129, 130, 276, 277, 278, 303, 300, 306; 72/703

[56] References Cited

U.S. PATENT DOCUMENTS

| | | | |
|---|---|---|---|
| 2,273,967 | 2/1942 | Leech | 72/703 X |
| 2,577,423 | 12/1951 | Ludwig et al. | 72/703 X |
| 3,017,697 | 1/1962 | Wlodek | 72/703 |
| 3,312,051 | 4/1967 | Schumann et al. | 57/306 X |
| 3,491,526 | 1/1970 | Krauss et al. | 242/19 X |
| 3,731,479 | 5/1973 | Flowers et al. | 57/306 X |
| 4,094,134 | 6/1978 | Kazuo | 57/306 |
| 4,543,778 | 10/1985 | Koella, III et al. | 57/303 |
| 5,311,732 | 5/1994 | Friedrich | 57/306 X |
| 5,319,917 | 6/1994 | Bothner et al. | 57/304 |

FOREIGN PATENT DOCUMENTS

| | | | |
|---|---|---|---|
| 715294 | 8/1965 | Canada | 72/703 |
| 2461621 | 7/1975 | Germany . | |
| 9017627.8 | 6/1991 | Germany . | |
| 55-132722 | 10/1980 | Japan . | |
| 60-21923 | 2/1985 | Japan . | |

*Primary Examiner*—Michael R. Mansen
*Attorney, Agent, or Firm*—Herbert Dubno; Andrew Wilford

[57] ABSTRACT

A spinning-machine spindle rotatable about an axis has an upper cop-holding region and a lower nonsmooth reserve surface. The reserve surface is formed as a substantially uniform array of tiny pits separated by a raised continuous land extending as a continuous grid over the surface. Normally the pits are of pyramidal shape and the land lies substantially on a surface of revolution centered on the axis.

6 Claims, 3 Drawing Sheets

SPINDLE FOR SPINNING MACHINE WITH KNURLED RESERVE SURFACE

FIELD OF THE INVENTION

The present invention relates to the spindle of a spinning machine. More particularly this invention concerns the knurled reserve surface of such a spindle and a system for creating it.

BACKGROUND OF THE INVENTION

A standard ring-spinning or -twisting machine has a spindle bank on which a plurality of upright spindles arranged in a row are rotatable about vertical axes. These spindles normally carry sleeves or quills on which respective yarns or rovings are wound to form the desired yarn packages or cops. The yarns run over ring guides or the like to the respective spindles.

Once a package is complete, the respective guide drops down to a level below the sleeve and winds several turns of the yarn around a lower reserve surface on the respective spindle that is knurled to prevent the yarn from slipping on it. When the sleeve is subsequently doffed, the yarn breaks, leaving the leading end of the incoming yarn wound around the lower reserve surface of the spindle. Then a new spindle is set in place and the winding operation starts again with the yarn caught on the lower reserve surface being caught on the new sleeve and wound up, repeating the cycle.

Clearly a problem with this system is that the reserve surface quickly gets fouled with the yarn, since several turns are added each time the sleeve is changed. These reserve surfaces must be cleared periodically. U.S. Pat. Nos. 3,312,051, 4,094,134, 5,311,732, and 5,319,917 and German patent document 2,461,621 describe apparatuses which rub, brush, and/or scrape the windings off the reserve surface.

While ideally the reserve surface should be cleaned thoroughly each time the cop is doffed, in reality it is fairly difficult to get all the yarn off it. The problem is that the knurling of the reserve area is formed in the traditional way with a knurling tool formed with a succession of pyramid-shaped recesses flanked by a pair of ridges. Thus the resultant knurling is constituted as an array of pyramid-shaped points separated by annularly continuous or helical grooves. The filament lodges readily in these grooves and whatever tool is being used to remove the yarn windings on the reserve surface has a hard time getting it out.

Japanese patent document 60-21923 of 4 February 1985 of Fukuda proposes flattening the tops of the normally pointed bumps produced by knurling. Such an arrangement still leaves annular or helical grooves in which the yarn can lodge. In addition U.S. Pat. No. 4,543,778 of Koella decribes a system for laying the yarn on the reserve system in a particularly easy-to-remove pattern, but even so this arrangement allows the yarn to lodge in the knurling.

OBJECTS OF THE INVENTION

It is therefore an object of the present invention to provide an improved spindle for a ring-spinning machine.

Another object is the provision of such an improved spindle for a ring-spinning machine which overcomes the above-given disadvantages, that is whose reserve surface is easier to clean than the prior-art reserve surfaces.

A further object is to provide an improved system or tool for knurling a workpiece like the reserve surface of a ring-spinning spindle.

SUMMARY OF THE INVENTION

According to the instant invention a spinning-machine spindle rotatable about an axis has an upper cop-holding region and a lower nonsmooth reserve surface. The reserve surface is formed as a substantially uniform array of tiny pits separated by a raised continuous land extending as a continuous grid over the surface. Normally the pits are of pyramidal shape and the land lies substantially on a surface of revolution centered on the axis.

Thus with this system no yarn will be able to wedge in a groove on the reserve surface. Instead every yarn will be supported at a multiplicity of points as it crosses the land ridge separating pits. Even if by chance a significant length of yarn runs along a ridge, it will not be recessed in the surface but instead will be standing up above the reserve surface so it will be easy to remove. Furthermore, the basically smooth surface formed by the land as the spindle rotates can be approached very closely by a hard tool, for instance a blade, without damage to the surface of the blade.

According to further features of the invention the pits are each of quadrilateral shape. The land has continuous longitudinal sections each extending past a multiplicity of pits and transverse sections also each extending past a multiplicity of pits. Normally the pits are substantially square and the transverse sections are substantially perpendicular to the longitudinal sections.

Such a surface is created according to the invention by a knurling tool that has according to the invention a roller having a surface formed with an array of points separated by a grid-like array of grooves whose bases are all continuous. These points according to the invention are pyramidal. After using this knurling tool the reserve surface is machined by grinding or turning to ensure that the land is itself smooth and continuous. Such machining also makes the edges where the land meets the pits somewhat sharp so the yarn will hold well on it.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
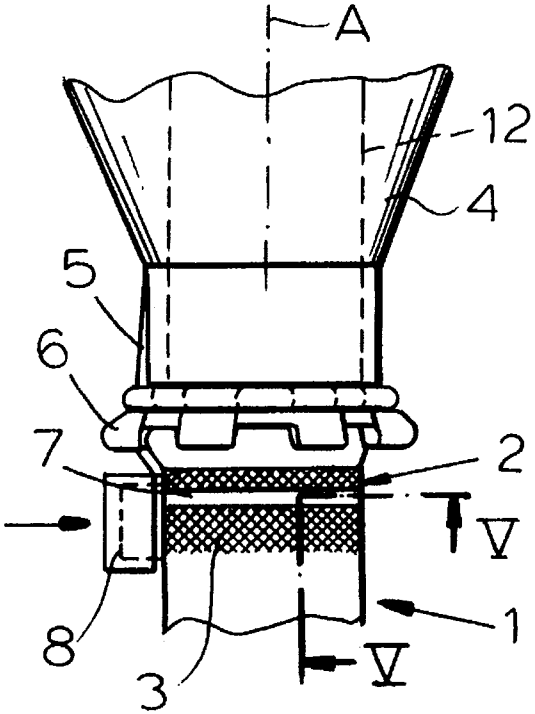
FIG. 1 is a side view of a portion of a ring-spinning machine according to the invention.

As seen in FIG. 1 a ring-spinning spindle 1 centered on and rotatable about a vertical axis A has a lower reserve surface formed with a knurling 3 and a upper region 12 adapted to hold a standard cop 4. A filament 5 extends from the cop through a collar guide 6 to the reserve surface 2 where it forms windings 7 on the knurling 3. A tool 8 can be approached radially to the surface 2 to strip a winding 7 of yarn 5 from it.

Figure 4:
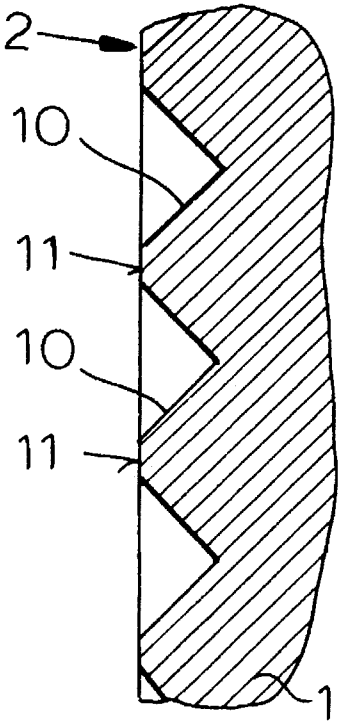
FIGS. 3 and 4 are sections taken along respective lines III—III and IV—IV of FIG. 2.
Figure 3:
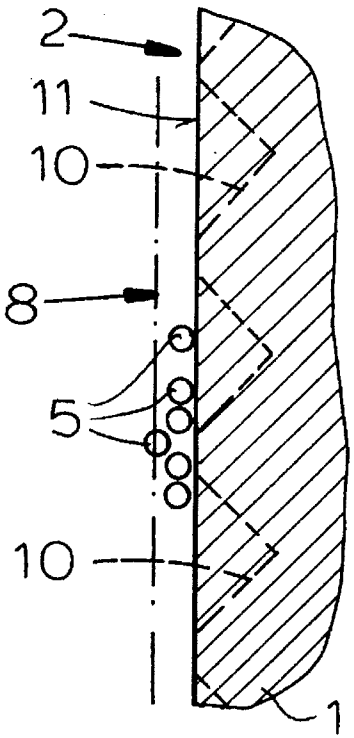
Figure 2:
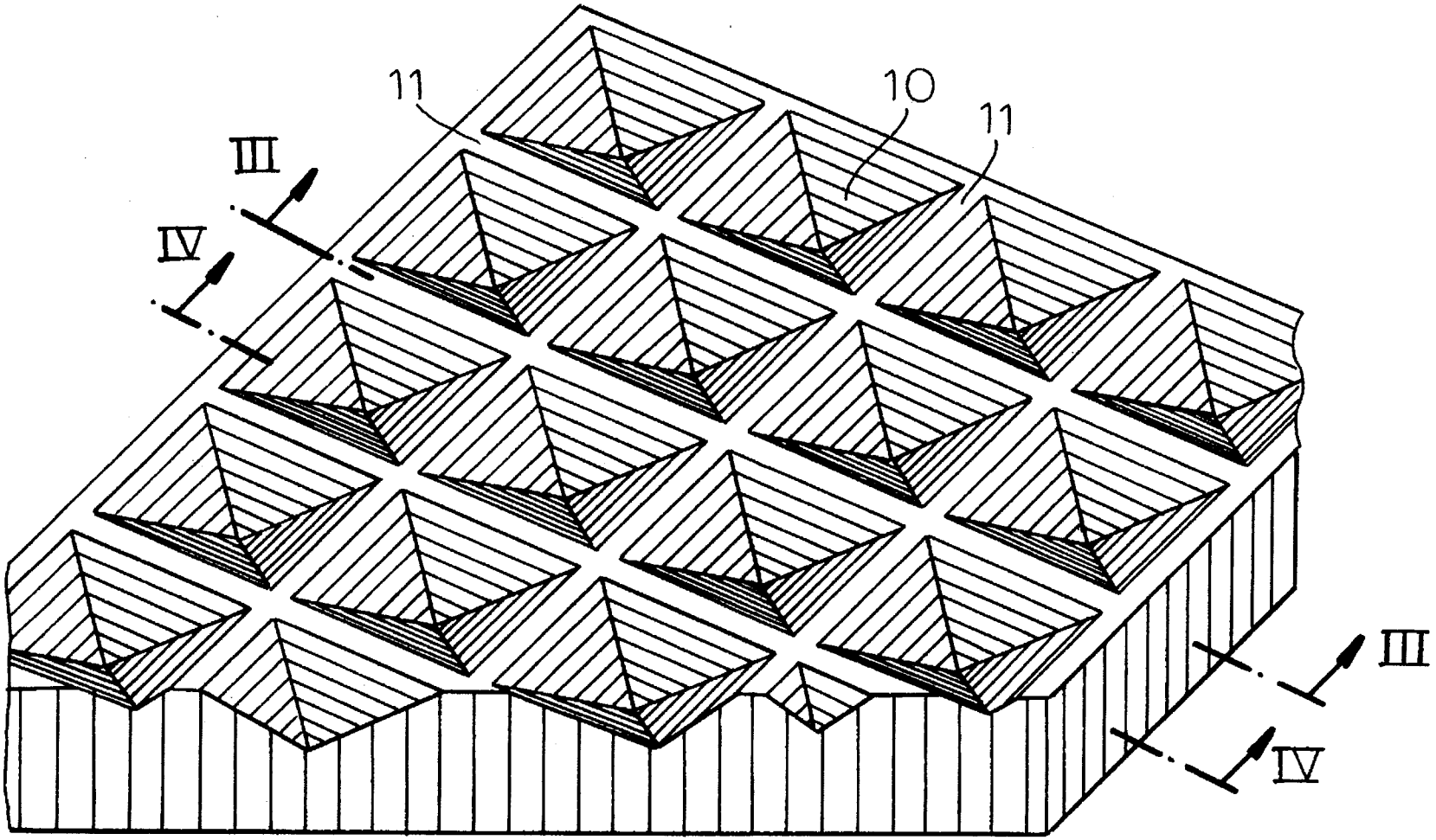
FIG. 2 is a large-scale perspective view of the reserve surface according to the invention shown flat for best view.

According to the invention as best seen in FIGS. 2, 3, and 4 the knurling 3 is formed by a uniform array of square pyramidal pits or depressions 10 separated by a land surface 11 extending like a grid between the pits 10. The entire land surface 11 lies on an imaginary cylinder centered on the axis A, although it is possible to form the surface 2 as another body of revolution, for instance barrel-shaped. In any case the land 11 extends longitudinally and transversely over the entire area of the surface 2.

Figure 5:
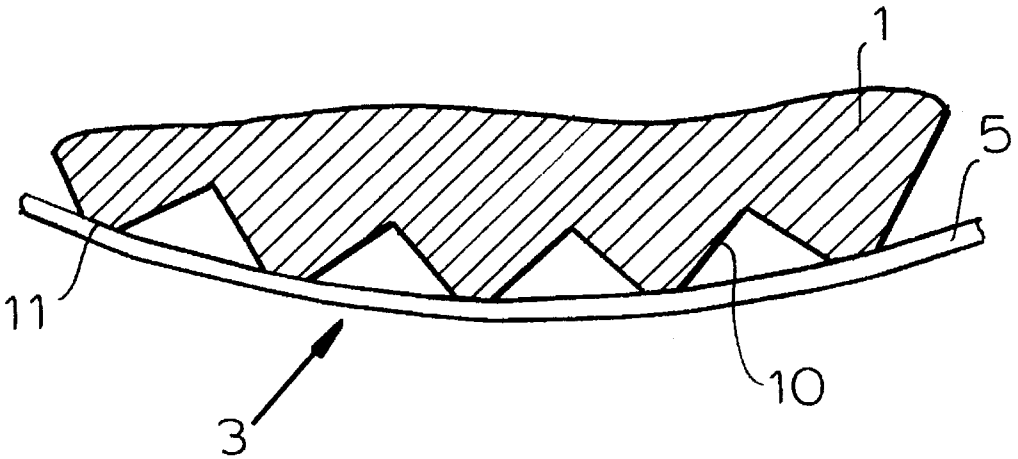
FIG. 5 is a large-scale cross section taken along line V—V of FIG. 1.

Thus as seen in FIG. 5 when the yarn 5 rides over the surface 2 this yarn 5 will not be able to lodge in the bottom of the pits 10. Instead it will have to sit up on the land 11 where it can easily be scraped or cut off by the tool 8.

Figure 6:
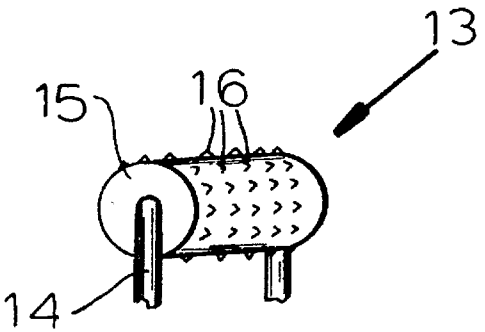
FIG. 6 is a small-scale perspective view of the head of a knurling tool according to the invention.

FIG. 6 shows a knurling tool 13 having a holder 14 in which is rotatable a roller 15 formed with an array of small pyramidal bumps 16. This tool is pressed against the surface 2 of the shaft 1 while it is rotating about its axis A and before the shaft 1 is hardened to form the pits 10. Then according to the invention the shaft 1 is ground or turned down a little to ensure that the land 11 lies perfectly on the above-discussed surface of revolution and to produce sharp edges at the transition between each pit 10 and the land 11.

We claim:

1. In a spinning-machine spindle rotatable about an axis and having an upper cop-holding region and a lower nonsmooth reserve surface, the improvement wherein the reserve surface is formed as a substantially uniform array of tiny pits separated by a raised continuous land extending as a continuous grid over the surface.

2. The improved spinning-machine spindle defined in claim 1 wherein the pits are of pyramidal shape.

3. The improved spinning-machine spindle defined in claim 1 wherein each pit has at the land a sharp edge.

4. In a spinning-machine spindle rotatable about an axis and having an upper cop-holding region and a lower nonsmooth reserve surface, the improvement wherein the reserve surface is formed as a substantially uniform array of tiny pits separated by a raised continuous land extending as a continuous grid over the surface and lying substantially on a surface of revolution centered on the axis.

5. The improved spinning-machine spindle defined in claim 4 wherein the pits are each of quadrilateral shape, the land having continuous longitudinal sections each extending past a multiplicity of pits and transverse sections also each extending past a multiplicity of pits.

6. The improved spinning-machine spindle defined in claim 5 wherein the pits are substantially square and the transverse sections are substantially perpendicular to the longitudinal sections.

* * * * *